United States Patent [19]

Flaum et al.

[11] 4,316,755

[45] Feb. 23, 1982

[54] ADHESIVE METERING DEVICE FOR CORRUGATING PROCESSES

[75] Inventors: Stephen S. Flaum, Brooklyn; Martin J. Leff, New York, both of N.Y.

[73] Assignee: S&S Corrugated Paper Machinery Co., Inc., Brooklyn, N.Y.

[21] Appl. No.: 205,315

[22] Filed: Nov. 10, 1980

Related U.S. Application Data

[62] Division of Ser. No. 22,141, Mar. 20, 1979, abandoned.

[51] Int. Cl.[3] ..... B31F 1/22

[52] U.S. Cl. ..... 156/205; 156/470; 156/578; 118/259; 118/410

[58] Field of Search ..... 156/205, 578, 470, 471, 156/472, 473; 118/259, 261, 410

[56] References Cited

U.S. PATENT DOCUMENTS

| | | | |
|---|---|---|---|
| 3,046,935 | 7/1962 | Wilson | 118/674 |
| 3,410,713 | 11/1968 | Schneidereit | 118/259 |
| 3,418,970 | 12/1968 | Phelps et al. | 118/416 |
| 3,703,459 | 11/1972 | Little et al. | 118/259 |

*Primary Examiner*—Jerome W. Massie

*Attorney, Agent, or Firm*—Ostrolenk, Faber, Gerb & Soffen

[57] ABSTRACT

A method for producing corrugated board utilizes a glue applying means constructed with an elongated shoe floatingly mounted alongside of and urged toward a glue applicator roll by a fluid controlled biasing means. A longitudinally extending depression in the shoe is substantially closed by the glue roll to define a glue cavity to which glue is fed by a positive displacement pump. The shoe is mounted so that the downstream end of the shoe is movable away from the glue roll automatically as required to permit glue to exit from the cavity at the same rate it is supplied thereto. This provides what is effectively a self-adjusting nozzle or fluid distribution slot extending the full length of the shoe and through which glue is forced from the cavity to form a thin layer of uniform thickness on the outside of the glue roll. The latter applies such thin layer of glue directly to the flute tip of a corrugated web for joining a liner web to the corrugated web.

3 Claims, 5 Drawing Figures

310
311
312
314
316
317
318
319
321
324
315
401
402
405
406
PUMP
99
96
104
101
A
B
C
D
S
L
40
42
47
48
100
11
18
19

ADHESIVE METERING DEVICE FOR CORRUGATING PROCESSES

This is a division of U.S. Patent Application Ser. No. 22,141, filed March 20, 1979, now abandoned.

This invention relates to fluid metering devices in general and in particular relates to means for forming a glue film of controlled thickness on an applicator roll.

The hydrodynamics of glue makes it difficult to predict glue behavior accurately. In U.S. Pat. No. 3,046,935 issued July 31, 1962 to H. W. Wilson for a Gluing Control Means, devices are disclosed for controlling glue film thickness on an applicator roll as a function of machine speed and in this way control the amount of glue applied by the applicator roll to a moving member. Even though machine speed is of substantial significance in connection with application of known quantities of glue, perhaps a more significant factor is glue viscosity. That is, with prior art constructions, glue film thickness on an applicator roll was subject to relatively wide uncontrolled variations because of changes in glue viscosity brought on typically by reason of non-uniform glue quality and variation in glue temperature.

Another problem that arises with prior art devices which utilize metering rolls results from the fact that different glue mixtures result in different speed curves for the metering. These speed curves are difficult to determine and difficult to adjust.

In prior art devices having elongated glue rolls, mechanical imperfections, such as run out of the roll, prevent accurate formation of thin glue films. This last noted problem is becoming increasingly significant because of new adhesives which must be applied in especially thin films.

In accordance with the instant invention adhesive metering means is provided to assure that a known quantity of adhesive is placed on the applicator roll over a relatively wide range of machine speeds and despite the fact that glue viscosity varies over a considerable range.

In addition, the device of the instant invention is more readily kept running accurately despite practical problems of manufacture and maintenance.

More particularly, in accordance with the instant invention an elongated shoe is floatingly mounted alongside a glue applicator roll and is biased toward the roll. A glue cavity is formed through the cooperation of the outer surface of the applicator roll and a depression in the shoe. This cavity is always filled with glue and glue is delivered thereto by a positive displacement pump. The latter delivers a known quantity of glue over a relatively large range of glue viscosities. The glue pump delivers glue to the cavity at a pressure which forces glue out of the cavity through a distribution slot along one edge thereof to form a glue film on the applicator roll. Since the cavity is always filled with glue, the amount of glue delivered by the pump over a given time interval is necessarily forced from the cavity through the distribution slot so that a known quantity of glue is applied to the glue roll.

Accordingly, a primary object of the instant invention is to provide a novel method for producing corrugated board by utilizing an, improved device for distributing adhesives.

Another object is to provide a method for producing corrugated board by utilizing an adhesive distribution device which utilizes a positive displacement pump to deliver a known quantity of glue to a cavity which is partially bounded by the glue applicator roll.

Still another object is to provide a method for producing corrugated board by utilizing adhesive distribution means which is floatingly mounted alongside the glue applicator roll.

A further object is to provide a method for producing corrugated board by utilizing adhesive distribution means which is constructed to assure that glue is applied evenly to the entire glue applicator roll.

These objects as well as other objects of this invention shall become readily apparent after reading the following description of the accompanying drawings in which:

FIG. 1 is a fragmentary side elevation of a double backer including a glue control means constructed in accordance with teachings of the instant invention.

FIGS. 2 and 3 are fragmentary end views of the glue control means taken through the respective lines 2—2 and 3—3 of FIG. 4 looking in the direction of arrows 2—2.

Figure 1:
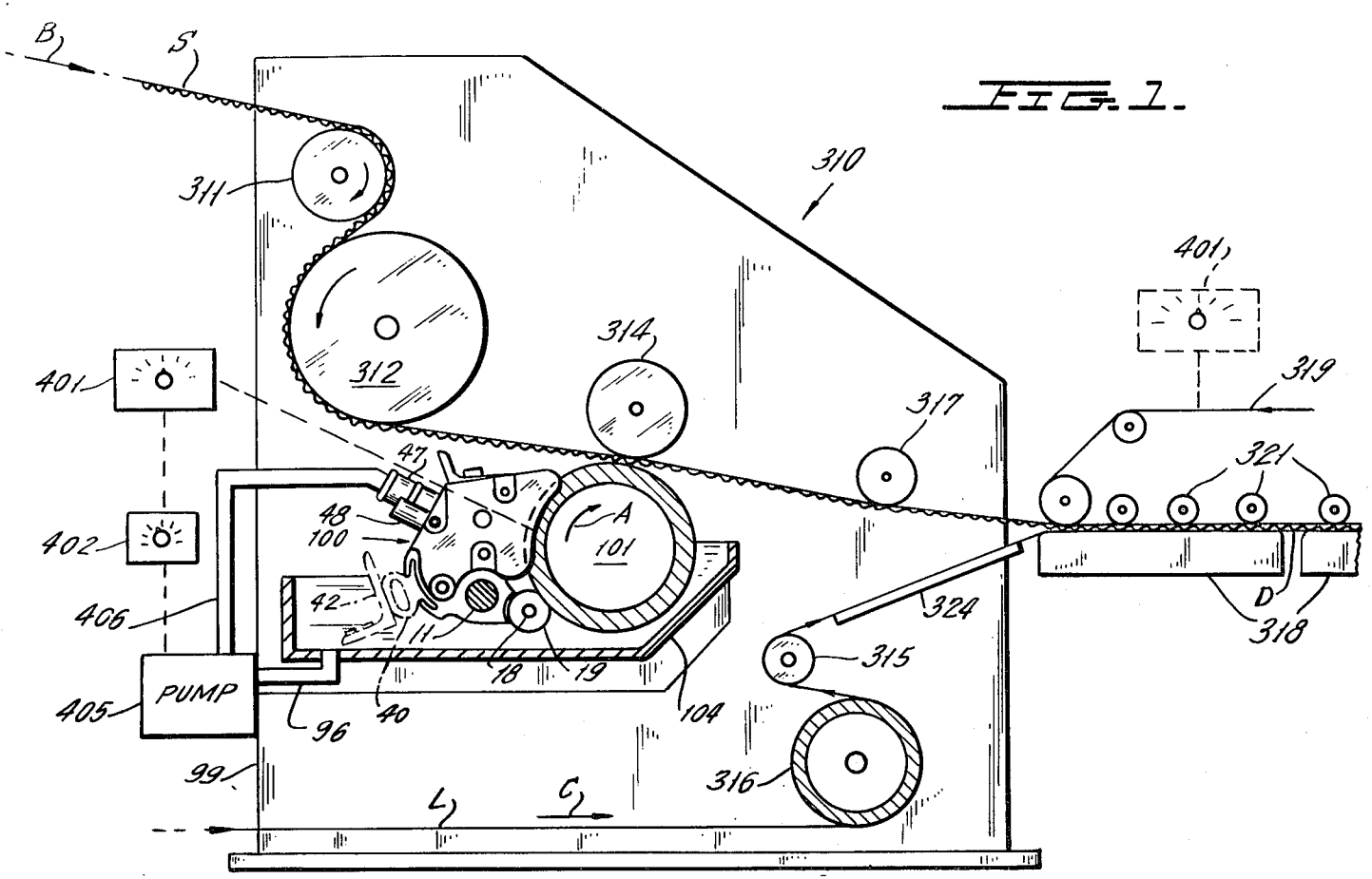
Figure 2:
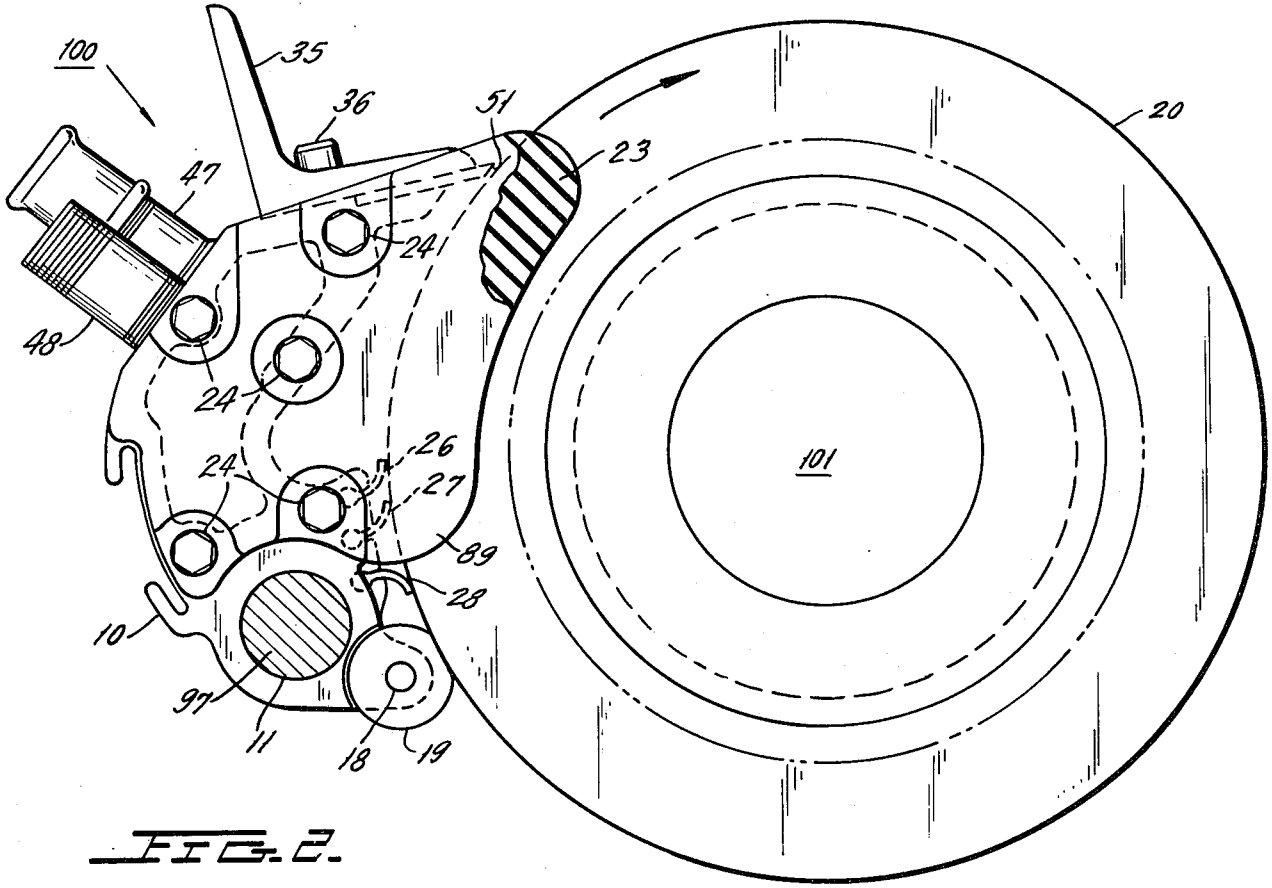
Figure 3:
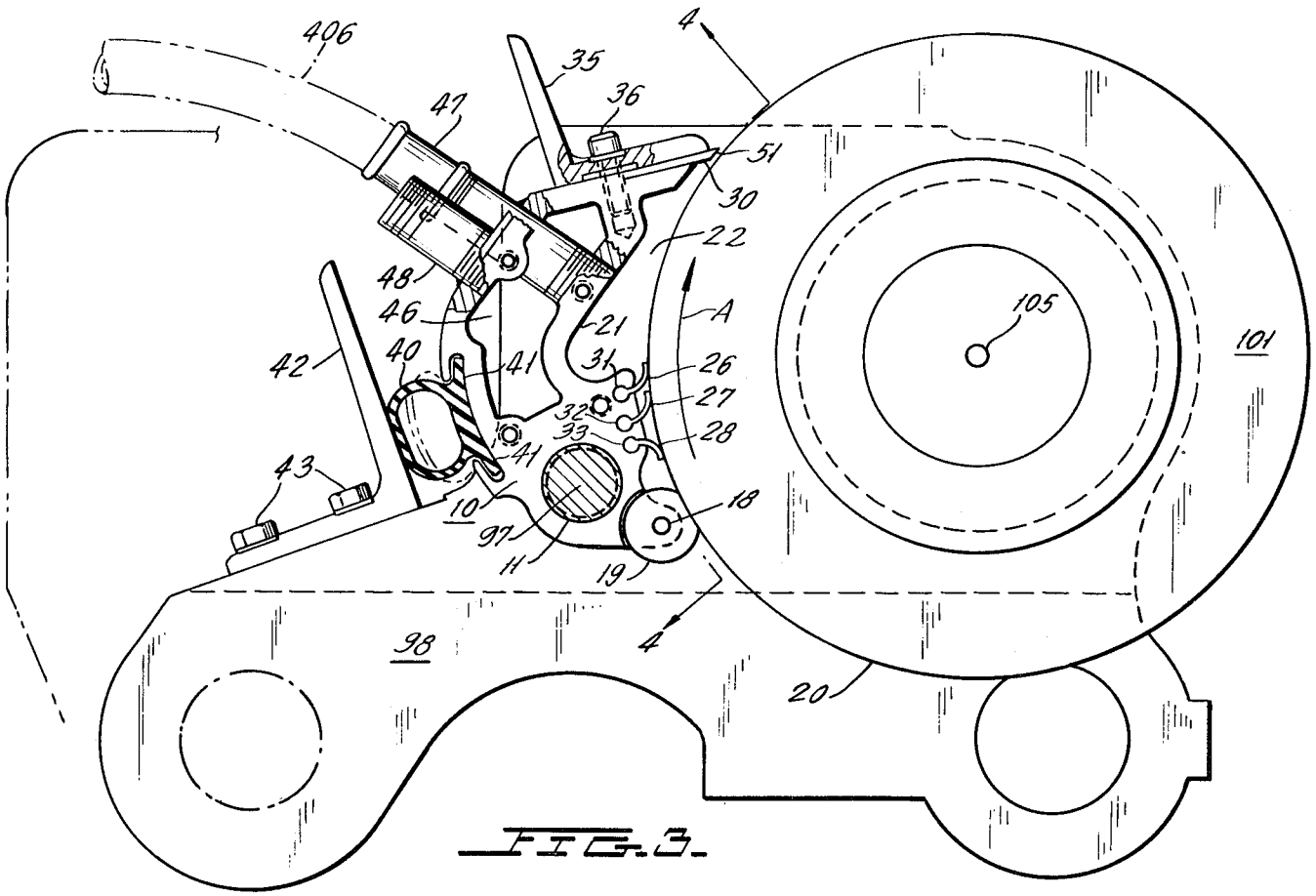
Figure 4:
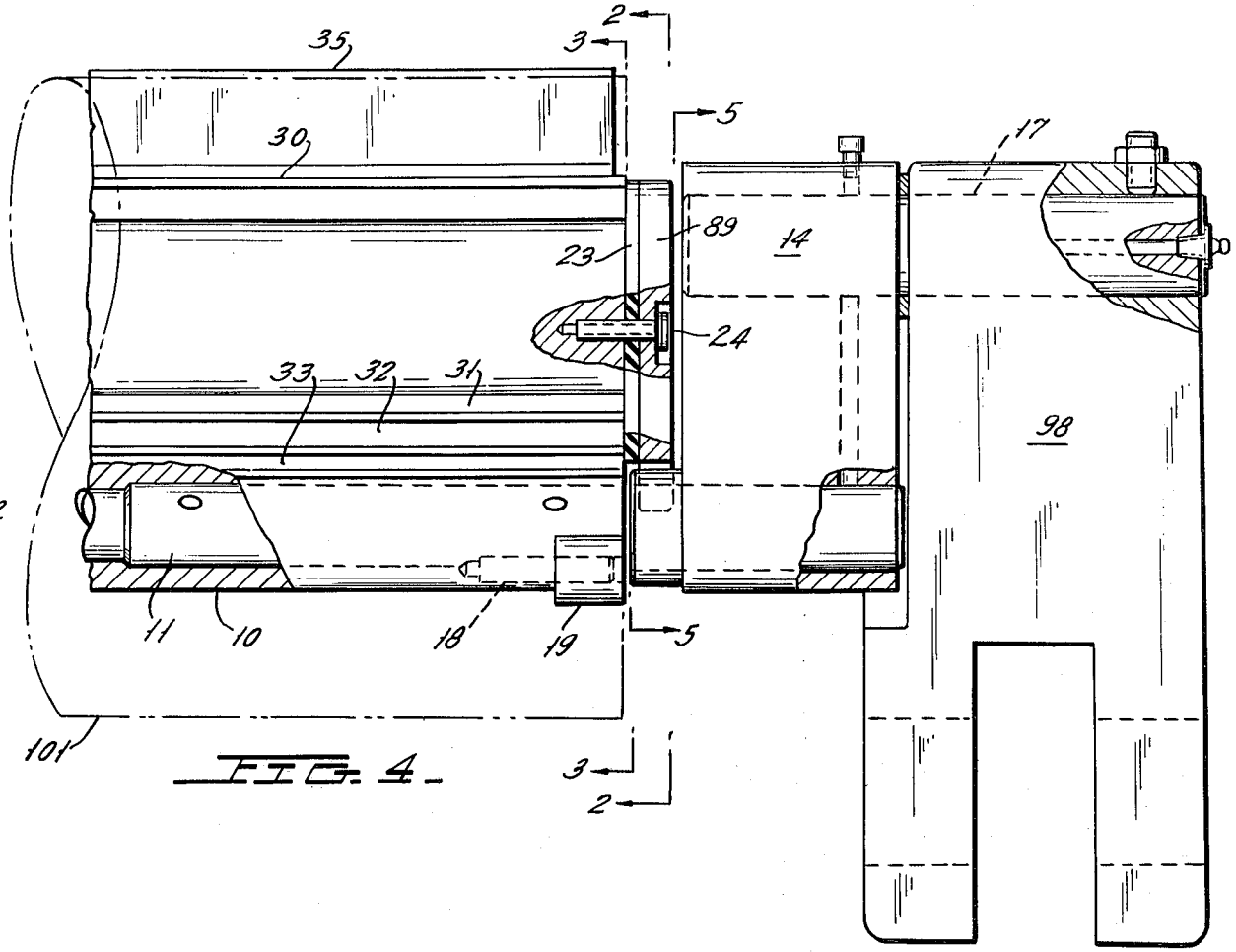
FIG. 4 is a side elevation of the glue control means shoe and mounting therefore looking in the direction of arrows 4—4 of FIG. 3.
Figure 5:
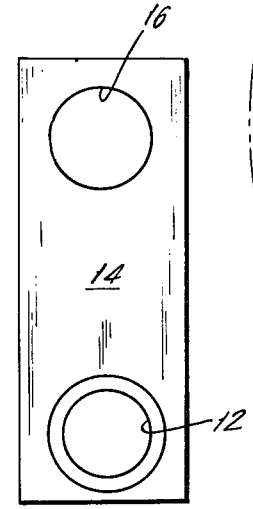
FIG. 5 is an elevation looking in the direction of arrows 5—5 of FIG. 4 and showing one of the pivoted arms to which the shoe of the glue control means is mounted.

Now referring more particularly to FIG. 1 which illustrates portion 310 of a double backer which provides double faced board D by adding a second line L to single faced board S. Single faced board S moves in the direction indicated by arrow B around idler roll 311, partially wraps around preheater drum 312 and passes through the nip between pressure roll 314 and glue applicator roll 101 where glue is applied to the free flute tips of single faced board S. Thereafter, the board S moves below deflector roll 317 into the nip between the lower flight of traction belt 319 and the upstream or leftmost steam chest 318 where liner L, moving in the direction of arrow C, joins single faced board S to form double face board D. Upstream of steam chests 318 liner L passes partly around rotating steam chest 316, partly around idler 315 and over support table 324. In a manner well known to the art, board D passes over and is supported by a plurality of steam chests 318 while being engaged from above by moving traction belt 319 have a plurality of weight rolls 321 acting downward on the lower flight thereof to maintain board D in heat transferring relationships with steam chests 318.

When the corrugating processs being used does not require heating of liner L or heating of single faced board S, preheaters 312 and 316 may be eliminated and/or replaced by low friction supports. Similarly, preheaters 312, 316 and steam chests 318 may be deactivated by not being heated. The latter may be replaced by low friction supports.

Adhesive transfer or glue roll 101 is an elongated cylinder fed with adhesive from pan 104. Metering means are provided for the application of a uniform adhesive coating on glue roll 101 by means of control head 100 constructed in accordance with the instant invention and to be hereinafter described in detail.

Glue roll 101 and traction belt 319 as well as other elements of the double backer are synchronously driven from single variable speed main drive 401 by means of appropriate gearing and chains. That is, main drive 401 has one output that drives roller 101 and belt 319, indirectly through the belt and paper and another output which supplies the input to adjustable ratio coupler 402. The output of the latter is related to or synchronized with the input to coupler 402 furnished by main drive 401, and drives positive displacement glue pump 405. Typically, the latter is a piston pump which delivers a known quantity (volume) of glue for a given pump speed even though glue viscosity changes over a relatively wide range and/or there are relatively large changes in back pressure on the pump. Pump 405 receives glue from pan 104 and delivers glue through flexible conduit 406 to control head 100.

Now referring more particularly to FIGS. 2 through 5 for a detailed description of the glue metering means including control head 100. In a manner well known to the art, the opposite ends of glue roll 101 are of reduced diameter and are journalled in bearings (not shown) mounted to frame section 98 which is adjustably mounted on main frame 99 (FIG. 1). These bearings are so positioned that glue roll 101 is rotated about its cylindrical axis 105 by main drive 401 in a direction indicated by arrow A. Floatingly mounted rearward and alongside of glue roll 101 is elongated extruded shoe 10. Aligned rods 11 extend from opposite ends of shoe 10 into bores 12 at the lower ends of arms 14 whose upper ends are provided with bores 16 which receive aligned stub-shafts 17. The latter extend into aligned apertures in adjustable frame section 98. In this manner shaft sections 17 pivotally mount arms 14 to frame sections 98, and shafts 11 pivotally mount shoe 10 to the ends of arms 14 opposite shafts 17. As will hereinafter be seen, this permits shoe 10 to move forward and rearward with respect to frame member 98 on which shoe 10 is mounted.

Aligned stub shafts 18 at opposite ends of shoe 10 pivotally connect the latter to wear elements 19 which ride on the outer surface 20 of glue roll 101 in sliding engagement therewith. However, shoe 10 is free to pivot on the secondary axis defined by aligned stub shafts 18. This secondary axis is parallel to main axis 97 and glue cylinder axis 105.

The forward face of shoe 10 is provided with depression 21 which partially defines glue cavity 22. The latter is also bounded by a portion of glue roll surface 20. Five screws 24 at each end of shoe 10 secure plastic plates 23 and their backing plates 89 to opposite ends of shoe 10. Plates 23 define the end boundaries for glue cavity 22, and extend forward of shoe 10 to partially overlap the ends of glue roll 101 in glue sealing engagement therewith. Each of the three identical plastic splines 26, 27, 28 has an enlargement along one of its edges, that is captured within the respective longitudinal recesses 31, 32, 33 of shoe 10. Splines 26, 27, 28 are disposed upstream of cavity 22 with spline 26 providing the upstream edge seal between shoe 10 and glue surface 20. In the event spline 26 provides an imperfect seal against surface 20, spline 27 takes over this sealing function. The most upstream 28 of these three splines 26–28 has its free edge extending upstream into engagement with surface 20 to act as a scraper which removes glue from portions of surface 20 before they are opposite shoe depression 21. The glue removed by scraper 28 falls into glue pan 104 which is connected through tube 96 to the intake of glue pump 405. Additional scraper or other cleaner means (not shown) may be provided upstream of scraper 28.

The downstream edge boundary for glue cavity 22 is formed by doctor blade 30 which is clamped to shoe 10 by one leg of angle iron 35. Clamping pressure is provided by a plurality of screws 36. The forward or free edge of blade 30, is, as will hereinafter be seen, biased toward engagement with glue roll surface 20.

Oppositely extending legs 41, 41 of elongated expandable bladder 40 are captured in complementary recesses of shoe 10 open at the rear thereof. Bladder 40 abuts one leg of angle iron 42 whose other leg is secured by screws 43 to frame section 98.

Shoe 10 is also provided with longitudinal passage 46 whose opposite ends are sealed by plates 23. Fittings 47, 48, threadably mounted to shoe 10, communicate with depression 21 and passage 46, respectively. Flexible hose 406 extends from glue pump 405 to fitting 47. For a reason to be hereinafter explained, fitting 48 may be connected to a source of temperature controlling fluid (not shown) and/or hose 406 may be jacketed with a controlled temperature fluid.

In operation, bladder 40 is filled with air or other fluid under pressure to provide a biasing force which urges shoe 10 forward toward glue applicator roll 101. In the absence of other external forces acting on shoe 10, wear elements 19 and the free edge 51 of blade 30 will engage outer surface 20 of glue roll 101. However, since cavity 22 is filled with glue and additional glue is being introduced into cavity 22 by pump 405, there is an external force on shoe 10 resulting from the pressure generated by pump 405 and this external force tends to move shoe 10 rearward or to the left with respect to FIG. 3. The net torque acting on shoe 10 around pivot 18 is counterclockwise. That is, the torque exerted by pump 405 on shoe 10 computed around pivot 18 exceeds the torque exerted by the fluid pressure in bladder 40 on shoe 10 around the same pivot 18, so that the net value of these torques tends to rotate shoe 10 rearward. Bladder 40 is positioned to exert more force on wear elements 19 than on blade 30, and cavity 22 is located closer to blade 30 than to wear elements 19, so that the shoe 10 tends to pivot counterclockwise and wear element 19 stays in contact with cylinder surface 20. This causes shoe 10 to pivot slightly about its secondary axis 18. The pivoted mounting arms 14 for shoe 10 permit the location of main axis 97 to shift as required to accommodate pivotal motion of shoe 10 about secondary pivot 18. The net effect of this pivoting motion for shoe 10 is to separate the free end 51 of blade 30 from outer surface 20 of glue roll 101 to form a narrow metering slot through which glue escapes from cavity 22 and deposits itself as a layer of controlled thickness on the portion of moving surface 20 downstream of blade 30.

It should now be obvious to those skilled in the art that the quantity of glue being forced from cavity 22 through the metering slot at free edge 51 of blade 30 is equal to the amount of glue being delivered by positive displacement pump 405. The width of this metering slot adjusts itself automatically to accommodate the quantity of glue being delivered to cavity 22. That is, during a given time interval, if the quantity of glue being delivered by pump 405 increases, the same quantity must be forced from cavity 22 through the metering slot. If the metering slot were to remain at the same width, the pressure within cavity 22 would increase and thereby urge shoe 10 to pivot counterclockwise. However, to prevent pressure buildup in cavity 22, the metering slot at free end 51 of blade 30 automatically increases in width to permit an increased flow rate for the glue leaving cavity 22.

When precise control of the temperature for glue within cavity 22 is required, liquid of controlled temperature (either hot or cold) is circulated through passage 46. This liquid is introduced through fitting 48. It is noted that even though only one fitting 48 is shown connected to passage 46, there is at least one additional fitting 48 mounted to shoe 10 and connected to passage 46. Further, even though one fitting 47 is shown communicating with glue cavity 22 there may be a plurality of fittings 47 spaced along the length of shoe 10 for introduction of glue into cavity 22 at a plurality of locations along the length thereof.

It should now be apparent to those skilled in the art that relatively flexible sealing splines 26, 27 may be replaced by more rigid sealing strips (not shown) and spring elements which act between shoe means 10 and these sealing strips to bias the latter into sealing engagement with cylindrical surface 20. Wear elements 19 may be extended across the entire length of shoe means 10 and may also serve as a seal.

While the instant invention has been described in connection with metering of glue, it is noted the teachings of the instant invention may be utilized for metering in flexo ink systems. It is also noted that by removing pressure from the inside of bladder 40, the fluid metering gap between cylindrical surface 20 and free edge 51 of blade 30 may be opened sufficiently for entry into cavity 22 for cleaning thereof.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method for manufacturing corrugated board comprising the steps of pumping adhesive into a cavity partially bounded by a rotating adhesive roll, said cavity having a transverse fluid distribution slot along its downstream edge, said cavity being formed in a floating shoe that extends parallel to the rotational axis of the adhesive roll and is biased toward said shoe with a force less than that force transmitted through adhesive in the cavity and urging the fluid distribution slot to enlarge, said adhesive being delivered to said cavity at a known rate and moving through the fluid distribution slot at a rate equal to the rate at which adhesive is delivered to said cavity to form an adhesive film on the periphery of the adhesive roll, forming transverse corrugations in a longitudinally moving web of paper and applying adhesive to the tips of the corrugations by bringing them into contact with said adhesive film, and thereafter applying a liner web to those tips to which said adhesive has been applied.

2. A method for manufacturing corrugated board as set forth in claim 1 in which the adhesive film as it is applied to the tips of the corrugations is of essentially the same thickness as when the adhesive film is adjacent the fluid distribution slot on the downstream side thereof.

3. A method for manufacturing corrugated board as set forth in claim 1 or 2 in which the rate at which adhesive is fed to said cavity is sufficient to maintain said cavity full and force adhesive through the fluid distribution slot.

* * * * *